US010234154B2

(12) United States Patent
Ramsay et al.

(10) Patent No.: US 10,234,154 B2
(45) Date of Patent: Mar. 19, 2019

(54) ROOF EXHAUST WITH COUNTERWEIGHTED DAMPER

(71) Applicants: Serge Ramsay, Montreal (CA); Linda Ramsay, Montreal (CA)

(72) Inventors: Serge Ramsay, Montreal (CA); Jean Wilson, Kirkland (CA)

(73) Assignees: Serge Ramsay, Montreal (CA); Linda Ramsay, Montreal (CA)

( * ) Notice: Subject to any disclaimer, the term of this patent is extended or adjusted under 35 U.S.C. 154(b) by 373 days.

(21) Appl. No.: 15/018,428

(22) Filed: Feb. 8, 2016

(65) Prior Publication Data

US 2017/0051929 A1 Feb. 23, 2017

Related U.S. Application Data

(63) Continuation-in-part of application No. 14/830,264, filed on Aug. 19, 2015.

(51) Int. Cl.

| | |
|---|---|
| ***E04D 13/17*** | (2006.01) |
| ***F24F 7/02*** | (2006.01) |
| ***F24F 13/14*** | (2006.01) |
| ***F24F 13/08*** | (2006.01) |
| ***F24F 11/74*** | (2018.01) |

(52) U.S. Cl.

CPC ..... *F24F 7/02* (2013.01); *E04D 13/17* (2013.01); *E04D 13/178* (2013.01); *F24F 11/745* (2018.01); *F24F 13/08* (2013.01); *F24F 13/081* (2013.01); *F24F 13/14* (2013.01); *F24F 13/1426* (2013.01); *F24F 13/1486* (2013.01); *F24F 2221/52* (2013.01)

(58) Field of Classification Search

CPC .. F24F 7/02; F24F 11/745; F24F 13/08; F24F 13/081; F24F 13/14; F24F 13/1426; F24F 13/1486; F24F 2221/52; E04D 13/17; E04D 13/178

USPC ..... 454/363

See application file for complete search history.

(56) References Cited

U.S. PATENT DOCUMENTS

| | | | | |
|---|---|---|---|---|
| 1,828,052 A * | 10/1931 | Knutson | ..... | F24F 13/1426 126/285 R |
| D155,345 S | 9/1949 | Johnson | | |
| 2,741,972 A * | 4/1956 | Pryne | ..... | F23L 17/02 454/27 |
| 3,168,861 A * | 2/1965 | Miller | ..... | F23L 17/06 454/39 |

(Continued)

*Primary Examiner* — Gregory L Huson
*Assistant Examiner* — Dana K Tighe
(74) *Attorney, Agent, or Firm* — Marshall, Gerstein & Borun LLP

(57) ABSTRACT

A roof exhaust for exhausting gas from a building is provided. The roof exhaust includes: an enclosure including a base and a hollow body extending from said base, the enclosure having side sections and a front section extending between the side sections; a conduit extending within the hollow body along a central axis, the conduit having an inlet connectable to a source of gas and an outlet for exhausting the gas from the conduit; a hood extending in the front section over the outlet, the hood comprising an aperture and being configured to direct gas exiting the outlet through the aperture in a downward direction towards the base; and a damper hingedly mounted relative to the outlet and including a counterweight configured to bias the damper towards a closed position.

20 Claims, 6 Drawing Sheets

(56) References Cited

U.S. PATENT DOCUMENTS

| | | | | |
|---|---|---|---|---|
| 3,209,669 | A | 10/1965 | Bayne | |
| 4,214,511 | A | 7/1980 | Mueller | |
| 4,625,630 | A * | 12/1986 | Carroll | B65D 88/741 403/241 |
| D304,367 | S | 10/1989 | Saas | |
| D349,458 | S | 8/1994 | Verdaguer | |
| 5,344,363 | A * | 9/1994 | Pollock | B65D 90/34 137/527.8 |
| 5,591,080 | A * | 1/1997 | Ward | F24F 7/02 454/359 |
| 5,632,678 | A * | 5/1997 | Doelfel | E04D 13/17 454/366 |
| 5,662,522 | A * | 9/1997 | Waltz | E04D 13/17 454/359 |
| D391,632 | S | 3/1998 | Thomas | |
| D448,468 | S | 9/2001 | Koessler | |
| 6,293,862 | B1 * | 9/2001 | Jafine | F24F 7/02 454/359 |
| 6,302,788 | B1 | 10/2001 | Gagnon | |
| 6,422,936 | B1 | 7/2002 | Van Gilst et al. | |
| 6,932,690 | B2 | 8/2005 | Ramsay | |
| 6,994,622 | B2 * | 2/2006 | Koessler | F24F 7/02 454/367 |
| 8,205,401 | B2 | 6/2012 | Ward | |
| D675,719 | S * | 2/2013 | Eicher | D23/373 |
| 8,381,459 | B2 | 2/2013 | Ramsay et al. | |
| D678,996 | S | 3/2013 | Jones | |
| D705,419 | S * | 5/2014 | Leonard | D23/373 |
| 9,080,779 | B1 * | 7/2015 | Leonard | F24F 11/0001 |
| 9,222,691 | B2 | 12/2015 | Ramsay et al. | |
| 9,441,854 | B2 | 9/2016 | Ramsay et al. | |
| 9,500,380 | B2 | 11/2016 | Ramsay et al. | |
| 2006/0025067 | A1 * | 2/2006 | Koessler | F24F 7/02 454/359 |
| 2006/0211356 | A1 * | 9/2006 | Grassman | F23J 13/08 454/4 |
| 2008/0242215 | A1 * | 10/2008 | Pagenstert | A01K 1/0064 454/284 |
| 2012/0178357 | A1 | 7/2012 | Rheaume | |
| 2012/0264363 | A1 * | 10/2012 | Ramsay | F24F 7/00 454/359 |
| 2013/0115871 | A1 | 5/2013 | Bourque et al. | |
| 2013/0344793 | A1 | 12/2013 | Hopper et al. | |
| 2016/0131392 | A1 * | 5/2016 | Mantyla | F24F 13/082 454/353 |

* cited by examiner

ROOF EXHAUST WITH COUNTERWEIGHTED DAMPER

FIELD

The present invention relates to exhaust devices. More particularly, it relates to roof exhausts such as ones used in combination with apparatuses such as laundry dryers and bathroom or stove ventilators.

BACKGROUND

Roof exhausts are commonly installed on buildings and serve to expel air or other gases through the building's roof. They generally include an exhaust duct passing through the roof, the exhaust duct having an outlet opening outside the building and an inlet inside the building and connected to a laundry dryer, a bathroom ventilator, a stove ventilator, or the like. Air or other gas originating from inside the building is able to travel outside under pressure generated by a fan or a blower.

It is preferred to design the roof exhaust to prevent foreign objects from entering the building through the exhaust, and to prevent blockage of the exhaust. This is commonly achieved by providing an enclosure to protect the exhaust outlet while allowing air to flow out through the exhaust unobstructed. In some implementations, such roof exhausts include a downward-facing outlet shielded by a deflector. This prevents wind blowing on the exhaust from entering the outlet, and also allows the exhaust to function even when covered with snow.

Existing roof exhaust designs still have room for improvement. Many designs are susceptible to condensation buildup and ice formation which can cause damage to both the exhaust and to the roof. An improved roof exhaust is therefore needed which can overcome at least some of the shortcomings of the prior art.

SUMMARY

According to an aspect, a roof exhaust for exhausting gas from a building is provided. The roof exhaust includes: an enclosure including a base and a hollow body extending from said base, the enclosure having side sections and a front section extending between the side sections; a conduit extending within the hollow body along a central axis, the conduit having an inlet connectable to a source of gas and an outlet for exhausting the gas from the conduit; a hood extending in the front section over the outlet, the hood including an aperture and being configured to direct gas exiting the outlet through the aperture in a downward direction towards the base; and a damper hingedly mounted relative to the outlet, the damper being movable between a closed position in which the damper substantially covers the outlet, and an open position in which the damper extends away from the outlet, wherein the damper including a counterweight configured to bias the damper towards the closed position.

In an embodiment, the damper includes a hinge for hingedly mounting the damper relative to the outlet, and the counterweight includes a mass attached to the damper and spaced away from the hinge.

In an embodiment, the counterweight includes an arm secured to the damper, and the mass is secured to an end of the arm away from the damper.

In an embodiment, the damper is angled towards the aperture when in the closed position.

In an embodiment, the roof exhaust further includes a condensation guide extending from a lower portion of the outlet of the conduit and angled towards the aperture, thereby guiding condensation building up in the conduit to exit through the aperture.

In an embodiment, the damper defines a partial opening together with the conduit while the damper is in the closed position.

In an embodiment, the damper is movable between the closed position and the open position in response to a pressure of the gas being exhausted from the conduit.

In an embodiment, the damper includes a flap, and the flap is hingedly mounted to the conduit.

In an embodiment, the roof exhaust further includes a baffle extending in the hood and sloped towards at least one of the side sections, the baffle being configured to deflect gas exiting the aperture in a lateral direction substantially perpendicular to the downward direction.

In an embodiment, the baffle has a shape substantially resembling an inversed "V", thereby deflecting the gas exiting the aperture in two directions opposite one another.

In an embodiment, the baffle defines, together with the hood, at least one channel directing the gas exiting the aperture away from the base.

In an embodiment, the hood includes a shield extending over the at least one baffle.

In an embodiment, the baffle includes an angled plate, the angled plate being angled away from the central axis by approximately 45 degrees.

In an embodiment, the baffle includes a first plate angled between 35 degrees and 55 degrees relative to the central axis, and a second plate extending from the first plate angled between 55 degrees and 90 degrees relative to the central axis.

In an embodiment, the conduit is isolated from the hollow body.

In an embodiment, the hollow body includes inner walls and the conduit includes an outer wall, the roof exhaust including an insulating space extending between said inner walls of the hollow body and said outer wall of the conduit, said insulating space being at least partially filled with an insulating material.

In an embodiment, the outer wall of the conduit is sealingly connected to the enclosure.

In an embodiment, the roof exhaust further includes a sealing element removably affixed to the base, said sealing element including an aperture through which the conduit extends.

According to an aspect, a kit for assembling a roof exhaust for exhausting gas from a building is provided. The kit includes: a conduit having an outer wall, a conduit inlet for connecting to a source of gas and a conduit outlet for exhausting the gas from the conduit; an enclosure positionable over the conduit, and a sealing element affixable to the base for sealingly connecting the conduit to the enclosure. The enclosure includes: a base mountable to a roof of the building; a hollow body extending from said base for housing a portion of the conduit including the conduit outlet; a central aperture in the base opening into the hollow body for allowing the conduit to pass therethrough; an enclosure outlet for exhausting gas from the enclosure; a hood positioned to extend over the conduit outlet when the enclosure is positioned over the conduit, the hood including the enclosure outlet and being configured to direct gas exiting the conduit outlet through the enclosure outlet in a downward direction towards the base; and a damper hingedly mounted relative to the conduit outlet, the damper being movable between a closed position in which the damper substantially covers the conduit outlet, and an open position in which the damper extends away from the conduit outlet, wherein the damper includes a counterweight configured to bias the damper towards the closed position. The sealing element includes: a body sized to sealingly cover the central aperture of the enclosure; a connector for connecting the body to the enclosure; and a central aperture in the body for allowing the conduit to pass therethough, the central aperture being sized to sealingly fit around an outer periphery of the conduit.

According to an aspect, a method for exhausting gas through a roof of a building is provided. The method includes the steps of: channeling gas to an exterior of the building upward through the roof; dampening a flow of the gas using a counterweighted flap; inverting the gas approximately 180 degrees in a downward direction towards the roof; and splitting the gas into at least two streams and exhausting the gas in a direction substantially parallel to the roof.

DETAILED DESCRIPTION

In the following description, the same numerical references refer to similar elements. The embodiments, geometrical configurations, materials mentioned and/or dimensions shown in the figures or described in the present description are preferred embodiments only, given solely for exemplification purposes.

Moreover, although the preferred embodiment of the roof exhaust and corresponding parts thereof consists of certain geometrical configurations as explained and illustrated herein, not all of these components and geometries are essential to the invention and thus should not be taken in their restrictive sense. It is to be understood, as also apparent to a person skilled in the art, that other suitable components and cooperation thereinbetween, as well as other suitable geometrical configurations, may be used for the roof exhaust without departing from the scope of the present invention. Moreover, it will be appreciated that positional descriptions such as "above", "below", "left", "right" and the like should, unless otherwise indicated, be taken in the context of the figures and should not be considered limiting.

Figure 1:
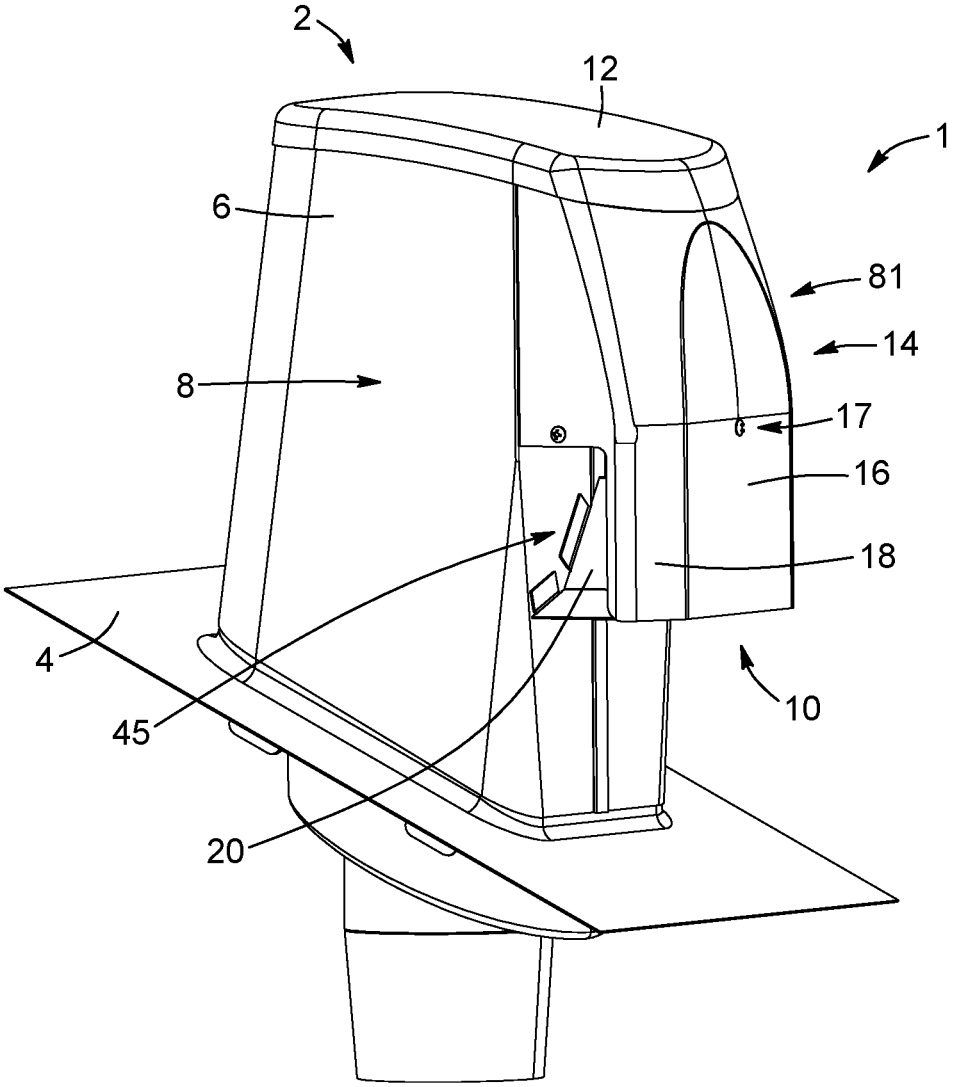
FIG. 1 is a top perspective view of a roof exhaust according to an embodiment.
Figure 2:
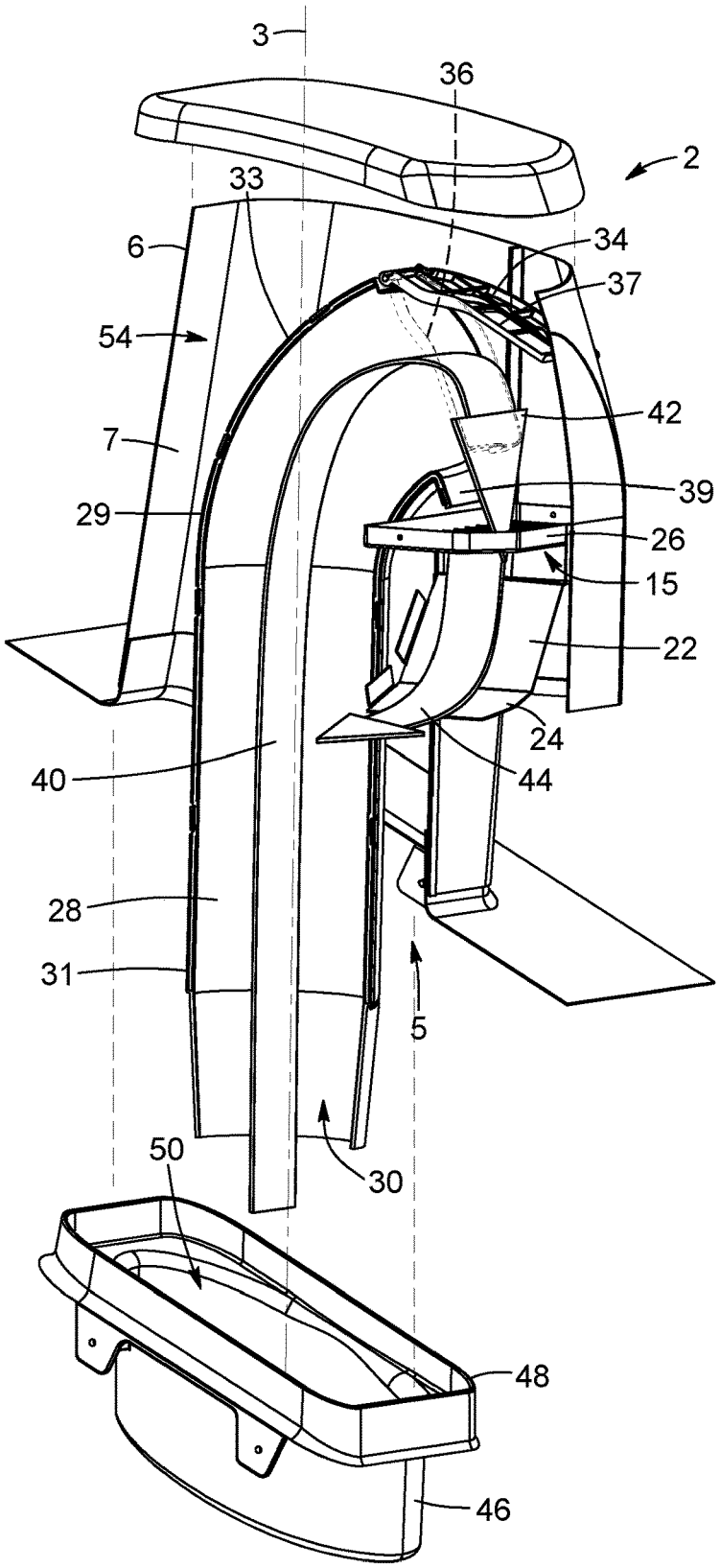
FIG. 2 is a partially exploded cross sectional view of the roof exhaust of FIG. 1, illustrating the flow path of gas as it travels through the conduit and out through the enclosure outlet.

With reference to FIGS. 1 and 2, a roof exhaust 1 is shown according to an embodiment. The exhaust 1 includes an enclosure 2 having a base 4 and a hollow body 6 extending therefrom, and being preferably made of corrosion-resistant metal. Other materials such as plastics are also possible. The base 4 has a central aperture 5 which opens up into the hollow body 6, allowing access to the interior of the hollow body 6 from underneath the base 4. The base 4 is substantially flat and planar and configured to be installed on a roof underneath shingles. As illustrated, the base 4 can be sloped to follow the slope of an angled roof, with the hollow body 6 extending therefrom at an angle such that the hollow body 6 is substantially vertical when the exhaust 1 is installed on the roof. A removable cap 12 can be provided for allowing access to the interior of the hollow body 6 for maintenance, for example.

The enclosure 2 has side sections 8, 8' opposite one another, the side sections 8, 8' residing in respective planes substantially parallel with the slope of the base 4. The enclosure 2 also has a front section 10 extending between the side sections 8, 8', and substantially perpendicular thereto. In the illustrated embodiment, the front section 10 extends above the base 4 along a lower end thereof. In the illustrated embodiment, a hood 10 is mounted to the front section 10, and includes a shield 16 with a substantially flat face 17 and an angled portion 18. A baffle 20 extends in the hood 14 which defines, together with the hood 14, a channel 45 which directs gas exiting the exhaust 1 away from the enclosure 2. Although in the present embodiment the hood 14 is mounted to the front section 10 of the hollow body 6, it should be understood that hood 14 can instead be formed as part of the hollow body 6 in a unitary piece.

A conduit 28 extends along a central axis 3 within the hollow body 6 for guiding gas through the roof exhaust. The conduit 28 has a lower section 31 extending below the base 4, the lower section 31 having an inlet 30 for connecting to a source of gas inside a building, such as a laundry dryer, a bathroom ventilator, a stove ventilator, a roof ventilator or the like. An upper section 33 of the conduit 28 extends inside the hollow body 6 and includes an outlet 32 for exhausting gas from the conduit 28 outside the building. The conduit 28 is isolated from the enclosure 2 in that an insulating space 54 is defined between inner walls of the hollow body 7 and an outer wall 29 of the conduit 28. The conduit 28 is further provided with a condensation guide 39 at the conduit outlet 32 to discharge condensation building up on the conduit 28.

The conduit 28 is configured to direct the gas and condensation out through an enclosure outlet 15. In the illustrated embodiment, the enclosure outlet 15 is provided in the hood 14 and opens to direct gas exiting the exhaust 1 in a downward direction 42 towards the base 4. In this configuration, wind blowing directly on the enclosure 2 is prevented from entering through the enclosure outlet 15. The shield 16 and its flat face 17 can serve deflect wind and further isolate the enclosure outlet 15 from wind. Furthermore, a removable grating 26 can also be provided along the enclosure outlet 15 thereby preventing foreign objects, such as animals or debris, from entering the enclosure outlet 15.

The baffle 20 is provided below the enclosure outlet 15. In other words, the baffle 20 is downstream from the enclosure outlet 15 along the path of the gas, causing gas exiting the enclosure outlet 15 to be redirected by the baffle 20. Preferably, the baffle 20 is sloped downwards towards the side section 8 of the enclosure 2, directing the exhausted gas in a lateral direction 44, and thus substantially parallel with the roof on which the exhaust is installed. Preferably still, the baffle 20 is spaced away from the base 4, creating more clearance for the exhausted gas. The spacing can be, for example, approximately at least one eighth of the height of the hollow body 6. To better redirect the gas, the baffle 20 can be provided with two or more angled plates. In the illustrated embodiment, first 22 and second 24 angled plates are provided. The first plate 22 has a steep angle to redirect the gas: approximately 45 degrees relative to the central axis 3, and preferably between 35 degrees and 55 degrees. The second plate 24 has a shallow angle in that it substantially parallel to the lateral direction 44. The second plate 24 is can be substantially perpendicular to the central axis and is preferably at an angle of between 55 degrees and 90 degrees relative to the central axis 3.

A damper can be provided for regulating gas flow in the conduit 28. In the illustrated embodiment, the damper is a flap 34 with a curved profile 35 hingedly mounted to the conduit 28. The flap 34 is movable between a closed position 36 in which is blocks the conduit outlet 32, and an opened position 37 where it extends away from the conduit outlet 32. Preferably, the flap 34 moves from the closed position 36 to the opened position 37 in response to a pressure of the gas being exhausted from the conduit 28.

Figure 6:
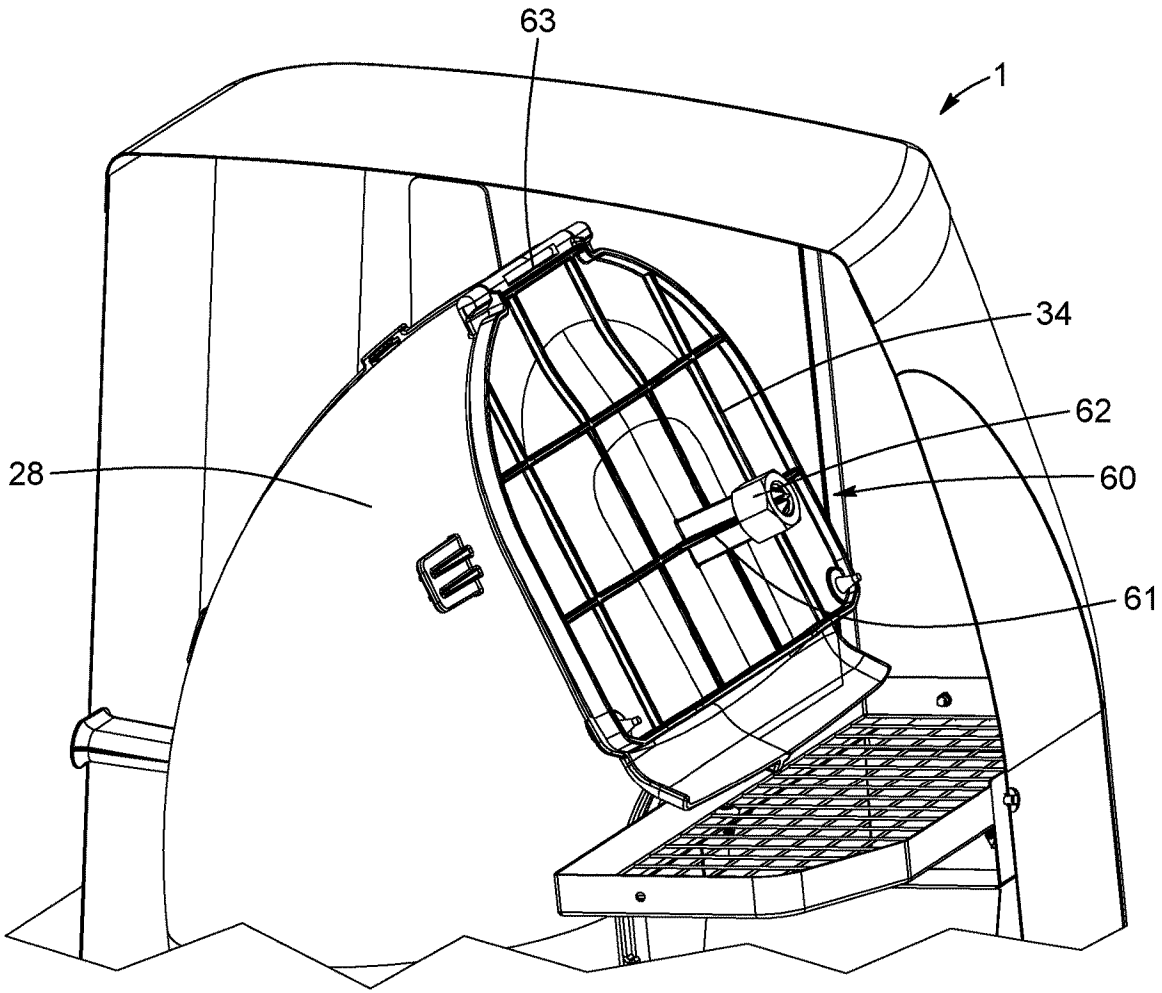
FIG. 6 is a partial cross section view of a roof exhaust according to an alternate embodiment, showing a damper with a counterweight at the outlet of the conduit.

In some embodiments, such as the one illustrated in FIG. 6, the flap 34 can be provided with a counterweight 60 for adjusting the dampening properties of the flap 34. The counterweight 60 can serve to provide the flap 34 with additional weight, thereby biasing the flap 34 towards the closed position, and requiring additional force to move the flap 34 towards the open position. As can be appreciated, if the flap 34 is made of plastic or other lightweight material, it will move to the open position in response to a relatively low pressure of gas exhausting from the conduit 28; such a behavior is not desirable for a damper. The provision of the counterweight 60 allows a lightweight flap 34 to behave as a proper damper: it will allow the flap 34 to better oppose movement, and thereby serve to better regulate gas flow from the conduit 28.

As can be appreciated, the counterweight 60 can be selected to tune the flap 34 to attain the desired dampening properties. For example, the counterweight 60 can be configured and positioned such that the flap 34 travels through maximum angle of approximately 30° between the open and closed position in response to a nominal pressure of gas exhausting from the conduit 28. It should be understood that the properties of the counterweight 60 can be selected according to the size and/or application of the roof exhaust 1. For example, a heavier and/or larger counterweight can be provided for a 6" than for a 4" exhaust, thereby allowing the flap 34 to better dampen a higher volume and/or pressure of gas flow. Moreover, the counterweight 60 can be positioned according to the desired properties of the flap 34. For example, the counterweight 60 can be positioned near a bottom portion of the flap 34, away from a hinge 63 connecting the flap 34 to the conduit 28, thereby creating a larger moment arm and allowing the counterweight 60 to better resist a rotative movement of the flap 34 about the hinge 63.

In the present embodiment, the counterweight 60 comprises a counterweight arm 61 and a mass 62. The arm 61 is fixed at one end to the flap 34 and at the other end to the mass 62. As can be appreciated, the arm 61 serves to secure the mass 62 to the flap 34, while spacing the mass 62 away from the flap 34. In this configuration, the arm 61 further spaces away the mass 62 from the hinge 63, creating a greater moment arm. Preferably, the mass 62 is removably attached to the arm 61, allowing it to be replaced with a different mass according to attain the desired properties of the flap 34. In the current embodiment, the mass 62 is a nut, but other types of commonly-available concentrated masses could also be used.

Although in the present embodiment the counterweight 60 is illustrated as comprising an arm 61 and a concentrated mass 62 in the form of a nut, it should be appreciated that other configurations are possible. For example, the counterweight 60 can comprise a mass distributed along the flap 34, or several masses at different positions on the flap 34. Moreover, although the term "counterweight" is used to describe this mechanism, other types of devices can also be used so long as they allow the flap 34 to attain the desired dampening properties. For example, the counterweight 60 can comprise a tension spring, an extension spring, or the like, configured to bias the flap 34 towards the closed position.

Referring back to the embodiment of FIGS. 1 and 2, the upper section 33 of the conduit 28 is curved, allowing the flap to be angled towards the enclosure outlet 15 while in the closed position 36. Furthermore, in the illustrated embodiment, the flap 34 does not completely cover the conduit 32 while in the closed position 36. The size of the flap 34 and the curved profile 35 are selected such that the flap has a partial opening 38 while in the closed position. This can allow some gas and excess humidity to discharge from the conduit even when the flap 34 is in the closed position 36, for example if gasses are being exhausted with low pressure. The curved profile 35 can further be complementary in shape with the inner walls of the hollow body 7, creating a seal therewith when the flap is in the opened position 37.

As can be appreciated, the configuration of the conduit 28, flap 34 and baffle 20 provide a drip management mechanism which encourages condensation to escape the enclosure 2. The condensation guide 39 provided on the conduit outlet 32 is angled such that moisture building up thereon slides out through the enclosure outlet 15 and thus towards an exterior of the enclosure 2. The size, shape and angle of the flap 34 are selected such that, even when in the closed position 36, condensation building up on the flap 34 drips onto the condensation guide 39 or drips directly out through the enclosure outlet 15. The baffle 20, being sloped downward towards the side section 8 of the enclosure 2, directs moisture dripping from the enclosure outlet 15 to run off on either side of the enclosure 2. In this fashion, moisture does not get trapped in the enclosure 2.

As can be further appreciated, the conduit 28, flap 34, hood 14 and baffle 20 direct gases flowing through the exhaust to follow a particular path. As illustrated in FIG. 2, gas entering the conduit 28 through the conduit inlet 30 flows in a generally upward direction 40. Next, the gas is inverted through approximately 180 degrees to flow in a generally downward direction 42 towards the enclosure outlet 15. In the illustrated embodiment, this inversion is achieved with the aid of the flap 34, hood 14 and a curve in the upper section 33 of the conduit 28. Once it passes through the enclosure outlet 15, gas is redirected by the deflector 20 in a lateral direction 44 substantially perpendicular to the upward and downward directions, and thus substantially parallel with the roof on which the exhaust 1 is installed. In other words, the gas is redirected by the deflector 20 as a stream which travels on a path in which the stream of gas will not come in contact with the roof before the stream is substantially diffused. It can be appreciated that overall, the gas follows a substantially helical path as it travels through the exhaust.

In the illustrated embodiment, the gas is guided in the lateral direction 44 with the help of a channel 45 defined by the shield 16 and the deflector 20. The channel 45 guides gas exiting through the enclosure outlet 15 in a deliberate path away from the roof and preferably away from the enclosure 2. The channel 45 includes a channel aperture 47 through which the gas is expelled. An angled portion of the deflector 20, such as the first angled plate 22, is disposed opposite the channel aperture 47. In this configuration, gas contacting the deflector 20 is guided out through the channel aperture 47 in a constrained path. The path is further constrained by the angled portion 18 of the shield 16, which can also serve to protect the channel 45 from wind.

Figure 3:
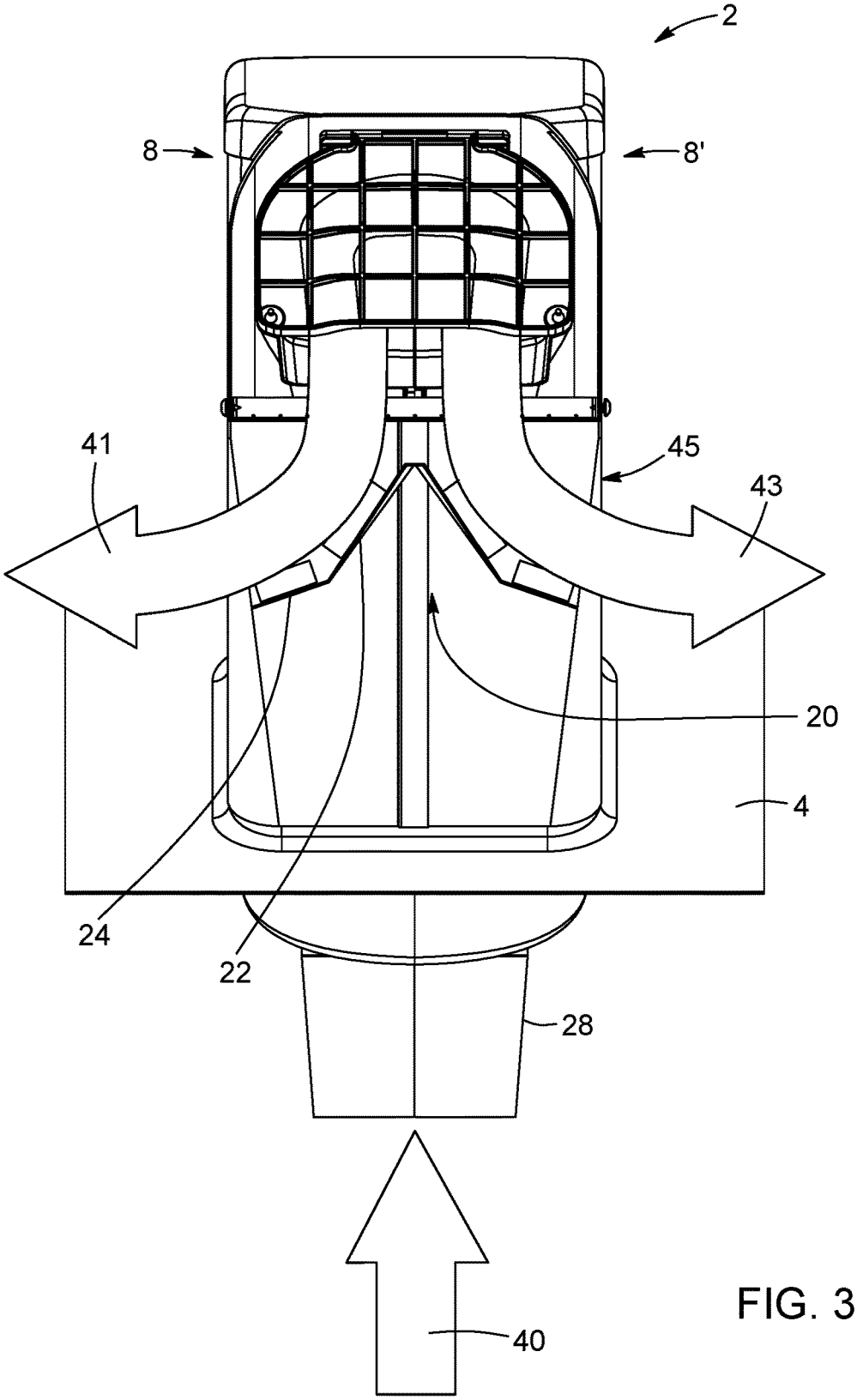
FIG. 3 is a partially transparent front view of the roof exhaust of FIG. 1, illustrating the flow of gas as it is separated into two streams by the deflector.

To more efficiently diffuse gas exiting the exhaust 1, it is preferred that the gas be separated into different streams as it exits the enclosure outlet 15. With reference to FIG. 3, the baffle 20 in the present embodiment has a shape substantially resembling an inversed "V". In this configuration, gas coming into contact with the baffle 20 is separated into first 41 and second 43 distinct streams, each of the streams 41, 43 travelling along a respective lateral direction opposite one another. Both streams are guided through respective channels 45 in the manner as described above so as to direct the gas away from the roof and away from the enclosure 2.

Figure 4:
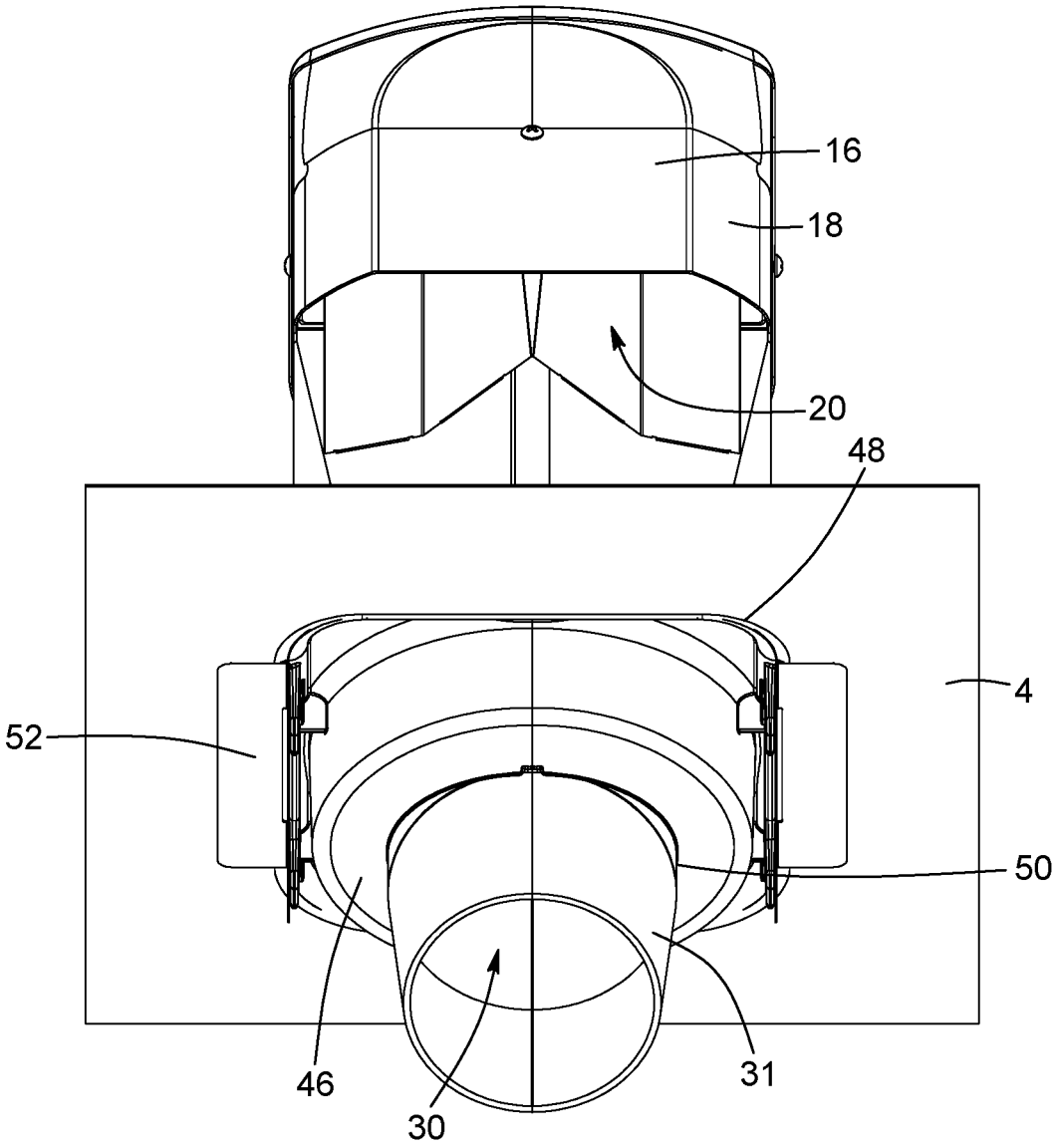
FIG. 4 is a bottom perspective view of the roof exhaust of FIG. 1, illustrating the sealing element in the base of the roof exhaust.

With reference now to FIG. 4, the roof exhaust 1 can be further provided with a removable sealing element for sealingly connecting the conduit 28 to the enclosure 2. In this configuration, there is an airtight seal between the conduit 28 and the enclosure 2, preventing gas from entering the interior of the hollow body 6 from below the base 4, and thus isolating the insulating space 54. In this fashion, the only pathway for gas to follow to enter the roof exhaust 1 is through the conduit inlet 30. Advantageously, this allows for the conduit 28 to be connected to a source of gas inside the building, while preventing ice from forming near the connection.

In the illustrated embodiment, the sealing element comprises a sealing element body 46 preferably made from plastic. The sealing element body 46 is configured to fill the space between the conduit 28 and the base 4. The body 46 includes a central aperture 50 for sealingly fitting around the outer walls 29 of the conduit 28, and a periphery 48 for sealingly fitting against the base, preferably along the central aperture 5 where the base 4 opens into the hollow body 6. A connector 52 can be provided for securing the sealing element body 46 to the base 4. In the illustrated embodiment, the connector 52 includes complementary plates on the sealing element body 46 and the base 4 securable by a bolt, screw or the like.

Figure 5:
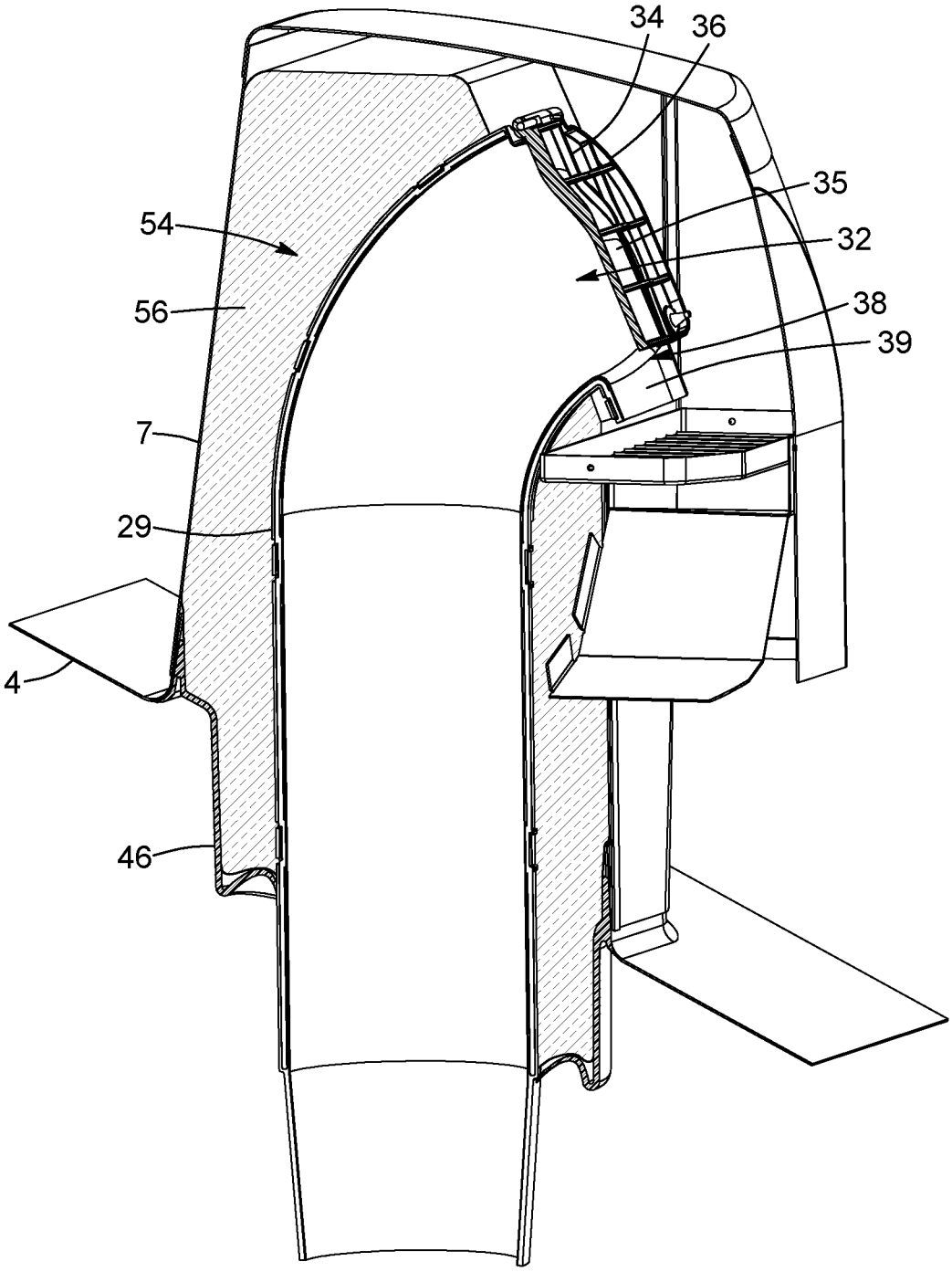
FIG. 5 is a cross section view of a roof exhaust according to an embodiment where the roof exhaust includes an insulator between the inner wall of the hollow body and the outer wall of the conduit.

As can be appreciated, the present configuration allows for the conduit 28 to be isolated from the enclosure 2. The conduit 28 is separated from the enclosure 2 via the insulating space 54, thereby preventing condensation buildup on the enclosure 2 due to humidity and temperature differences between the gas in the conduit 28 and ambient air around the enclosure 2. With reference to FIG. 5, the insulating space 54 can be filled with an insulator 56, such as foam or a moisture-resistant insulating material for example, to further increase the thermal resistance of the insulating space 54. As can be appreciated, the insulator 56 can be positioned inside the hollow body 6 so as to surround the conduit 28 in areas where air exiting the conduit 28 is susceptible to travel, and thus prevent moisture buildup inside the enclosure 2 or around the conduit 28.

The embodiment described above and illustrated herein is intended to be exemplary only. The overall configuration described above is but one possible embodiment of the invention. Other embodiments are also possible without departing from the scope of the invention. One skilled in the art will understand that some elements can be omitted while other can be substituted for equivalents without affecting the overall function of the invention. The embodiment presented herein should therefore be considered in all respects as illustrative and not restrictive.

The invention claimed is:

1. A roof exhaust for exhausting gas from a building, the roof exhaust comprising:

an enclosure comprising a base and a hollow body extending from said base, the enclosure having side sections, a front section extending between the side sections, and an enclosure outlet;

a conduit extending within the hollow body along a central axis, the conduit having a conduit inlet connectable to a source of gas and a conduit outlet for exhausting the gas from the conduit;

a hood extending in the front section over the conduit outlet, the hood being configured to direct gas exiting the conduit outlet through the enclosure outlet in a downward direction towards the base;

a damper hingedly mounted relative to the conduit outlet, the damper being movable between a closed position in which the damper substantially covers the conduit outlet, and an open position in which the damper extends away from the conduit outlet, wherein the damper comprises a counterweight configured to bias the damper towards the closed position; and a baffle extending in the hood and sloped towards at least one of the side sections, the baffle being positioned to deflect the downward-directed gas exiting the conduit outlet through the enclosure outlet in a lateral direction more perpendicular than parallel to the downward direction, wherein the baffle has a shape substantially resembling an inversed "V", thereby deflecting the gas exiting the enclosure outlet in two directions opposite one another.

2. The roof exhaust according to claim 1, wherein the damper comprises a hinge for hingedly mounting the damper relative to the outlet, and wherein the counterweight comprises a mass attached to the damper and spaced away from the hinge.

3. The roof exhaust according to claim 1, wherein the counterweight comprises an arm secured to the damper, and a mass secured to an end of the arm away from the damper.

4. The roof exhaust according to claim 1, wherein the damper is angled towards the enclosure outlet when in the closed position.

5. The roof exhaust according to claim 1, further comprising a condensation guide extending from a lower portion of the conduit outlet in an airspace above the baffle, the condensation guide being angled in a downward direction towards the baffle, thereby guiding condensation building up in the conduit to flow onto the baffle and exit the enclosure towards at least one of the side sections.

6. The roof exhaust according to claim 1, wherein the damper defines a partial opening together with the conduit while the damper is in the closed position.

7. The roof exhaust according to claim 1, wherein the damper is movable between the closed position and the open position in response to a pressure of the gas being exhausted from the conduit.

8. The roof exhaust according to claim 1, wherein the damper comprises a flap, and wherein the flap is hingedly mounted to the conduit.

9. The roof exhaust according to claim 1, wherein the baffle defines, together with the hood, at least one channel directing the gas exiting the enclosure outlet away from the base.

10. The roof exhaust according to claim 1, wherein the hood comprises a shield extending over the baffle.

11. The roof exhaust according to claim 1, wherein the baffle comprises an angled plate, the angled plate being angled away from the central axis by approximately 45 degrees.

12. The roof exhaust according to claim 1, wherein the baffle comprises a first plate angled between 35 degrees and 55 degrees relative to the central axis, and a second plate extending from the first plate angled between 55 degrees and 90 degrees relative to the central axis.

13. The roof exhaust according to claim 1, wherein the conduit is spaced apart from the hollow body and is not in directed contact therewith.

14. The roof exhaust according to claim 1, wherein the hollow body comprises inner walls and the conduit comprises an outer wall, the roof exhaust comprising an insulating space extending between said inner walls of the hollow body and said outer wall of the conduit, said insulating space being at least partially filled with an insulating material.

15. The roof exhaust according to claim 14, further comprising a seal between the outer wall of the conduit and the enclosure, thereby preventing gas from entering the insulating space from below the base.

16. The roof exhaust according to claim 1, further comprising a sealing element affixed to the base, said sealing element comprising an aperture through which the conduit extends, said sealing element further being removable from the base.

17. The roof exhaust according to claim 1, wherein the enclosure comprises a closed top section preventing down winds from entering the enclosure, wherein the conduit outlet comprises an upper portion and a lower portion, wherein the damper is hingedly mounted to the upper portion of the conduit outlet, and wherein the hood extends at least between the top section of the enclosure and a vertical position below the lower portion of the conduit outlet.

18. A kit for assembling a roof exhaust for exhausting gas from a building, the kit comprising:

a conduit having an outer wall, a conduit inlet for connecting to a source of gas and a conduit outlet for exhausting the gas from the conduit;

an enclosure positionable over the conduit, the enclosure comprising:

a base mountable to a roof of the building;

a hollow body extending from said base for housing a portion of the conduit comprising the conduit outlet;

a central aperture in the base opening into the hollow body for allowing the conduit to pass therethrough;

an enclosure outlet for exhausting gas from the enclosure;

a hood positioned to extend over the conduit outlet when the enclosure is positioned over the conduit, the hood comprising the enclosure outlet and being configured to direct gas exiting the conduit outlet through the enclosure outlet in a downward direction towards the base; and a damper hingedly mounted relative to the conduit outlet, the damper being movable between a closed position in which the damper substantially covers the conduit outlet, and an open position in which the damper extends away from the conduit outlet, wherein the damper comprises a counterweight configured to bias the damper towards the closed position; and a baffle extending in the hood configured to deflect the downward-directed gas exiting the conduit outlet through the enclosure outlet in a lateral direction more perpendicular than parallel to the downward direction, wherein the baffle has a shape substantially resembling an inversed "V", thereby deflecting the gas exiting the enclosure outlet in two directions opposite one another.

19. The kit according to claim 18, further comprising a sealing element for connecting the conduit to the enclosure and creating a seal therebetween, said sealing element comprising:

a body sized to cover the central aperture of the enclosure and create a seal therearound;

a connector for connecting to the body of the enclosure; and a central aperture in the body for allowing the conduit to pass therethrough, the central aperture being sized to fit around an outer periphery of the conduit and create a seal between the body and the conduit.

20. A roof exhaust for exhausting gas from a building, the roof exhaust comprising:

an enclosure comprising a base and a hollow body extending from said base, the enclosure having side sections, a front section extending between the side sections, and an enclosure outlet;

a conduit extending within the hollow body along a central axis, the conduit having a conduit inlet connectable to a source of gas and a conduit outlet for exhausting the gas from the conduit;

a hood extending in the front section over the conduit outlet, the hood being configured to direct gas exiting the conduit outlet through the enclosure outlet in a downward direction towards the base;

a damper hingedly mounted relative to the conduit outlet, the damper being movable between a closed position in which the damper substantially covers the conduit outlet, and an open position in which the damper extends away from the conduit outlet, wherein the damper comprises a counterweight configured to bias the damper towards the closed position;

a baffle extending in the hood and sloped towards at least one of the side sections, the baffle being positioned to deflect the downward-directed gas exiting the conduit outlet through the enclosure outlet in a lateral direction more perpendicular than parallel to the downward direction; and a condensation guide extending from a lower portion of the conduit outlet in an airspace above the baffle, the condensation guide being angled in a downward direction towards the baffle, thereby guiding condensation building up in the conduit to flow onto the baffle and exit the enclosure towards at least one of the side sections.

* * * * *